US009847158B2

(12) United States Patent
Hong et al.

(10) Patent No.: US 9,847,158 B2
(45) Date of Patent: Dec. 19, 2017

(54) GRAIN ORIENTED ELECTRICAL STEEL SHEET HAVING EXCELLENT CORE LOSS, AND METHOD FOR MANUFACTURING SAME

(71) Applicant: POSCO, Pohang-si, Gyeongsangbuk-do (KR)

(72) Inventors: Byung-Deug Hong, Pohang-si (KR); Dong-Kyun Kim, Pohang-si (KR)

(73) Assignee: POSCO, Pohang-si, Gyeongsangbuk-do (KR)

( * ) Notice: Subject to any disclaimer, the term of this patent is extended or adjusted under 35 U.S.C. 154(b) by 0 days.

(21) Appl. No.: 14/758,219

(22) PCT Filed: Dec. 28, 2012

(86) PCT No.: PCT/KR2012/011749
§ 371 (c)(1),
(2) Date: Jun. 26, 2015

(87) PCT Pub. No.: WO2014/104444
PCT Pub. Date: Jul. 3, 2014

(65) Prior Publication Data

US 2015/0340137 A1 Nov. 26, 2015

(30) Foreign Application Priority Data

Dec. 27, 2012 (KR) ..... 10-2012-0154611

(51) Int. Cl.
*H01F 1/147* (2006.01)
*C21D 8/12* (2006.01)
(Continued)

(52) U.S. Cl.
CPC ..... *H01F 1/14775* (2013.01); *C21D 6/001* (2013.01); *C21D 6/002* (2013.01);
(Continued)

(58) Field of Classification Search
CPC .... H01F 1/14775; H01F 1/14791; H01F 1/16; C21D 8/1222; C21D 8/1233;
(Continued)

(56) References Cited

U.S. PATENT DOCUMENTS

| | | | |
|---|---|---|---|
| 7,470,333 | B2 | 12/2008 | Ohashi et al. |
| 7,942,982 | B2 | 5/2011 | Kubo et al. |
| 2006/0243351 | A1 | 11/2006 | Ohashi et al. |

FOREIGN PATENT DOCUMENTS

| | | | |
|---|---|---|---|
| CN | 101541991 | A | 9/2009 |
| CN | 102383045 | A | 3/2012 |

(Continued)

OTHER PUBLICATIONS

International Search Report dated Jul. 3, 2013 issued in Interntional Patent Application No. PCT/KR2012/011749 (English translation thereof).

(Continued)

*Primary Examiner* — Colleen Dunn
*Assistant Examiner* — Anthony Liang
(74) *Attorney, Agent, or Firm* — McDermott Will & Emery LLP

(57) ABSTRACT

The present invention relates to a grain oriented electrical steel sheet having excellent core loss and to a method for manufacturing same. The electrical steel sheet according to one aspect of the present invention may have a composition comprising, by weight %, Si: 1.0 to 4.0%, Al: 0.1 to 4.0%, and a rare earth element: 0.0001 to 0.5% by the total content of the whole rare earth element.

9 Claims, 2 Drawing Sheets

(51) Int. Cl.

| | |
|---|---|
| ***C21D 6/00*** | (2006.01) |
| ***C22C 38/60*** | (2006.01) |
| ***C22C 38/00*** | (2006.01) |
| ***C22C 38/16*** | (2006.01) |
| ***C22C 38/34*** | (2006.01) |
| ***C22C 38/08*** | (2006.01) |
| ***C22C 38/40*** | (2006.01) |
| ***H01F 1/16*** | (2006.01) |
| ***H01F 41/02*** | (2006.01) |
| ***C21D 9/46*** | (2006.01) |
| ***C22C 38/06*** | (2006.01) |
| ***C22C 38/02*** | (2006.01) |
| ***C22C 38/04*** | (2006.01) |

(52) U.S. Cl.
CPC ..... *C21D 6/004* (2013.01); *C21D 6/008* (2013.01); *C21D 8/12* (2013.01); *C21D 8/1222* (2013.01); *C21D 8/1233* (2013.01); *C21D 8/1261* (2013.01); *C21D 9/46* (2013.01); *C22C 38/00* (2013.01); *C22C 38/001* (2013.01); *C22C 38/005* (2013.01); *C22C 38/008* (2013.01); *C22C 38/02* (2013.01); *C22C 38/04* (2013.01); *C22C 38/06* (2013.01); *C22C 38/08* (2013.01); *C22C 38/16* (2013.01); *C22C 38/34* (2013.01); *C22C 38/40* (2013.01); *C22C 38/60* (2013.01); *H01F 1/14791* (2013.01); *H01F 1/16* (2013.01); *H01F 41/02* (2013.01)

(58) Field of Classification Search
CPC ..... C21D 8/1261; C21D 9/46; C21D 6/008; C21D 6/001; C21D 6/002; C21D 6/004; C22C 38/02; C22C 38/06; C22C 38/005; C22C 38/60; C22C 38/001; C22C 38/008; C22C 38/16; C22C 38/24; C22C 38/04; C22C 38/08; C22C 38/40
See application file for complete search history.

(56) References Cited

FOREIGN PATENT DOCUMENTS

| | | | | |
|---|---|---|---|---|
| EP | 1632582 | A1 | | 3/2006 |
| JP | S60-141830 | A | | 7/1985 |
| JP | 2005-264280 | A | | 9/2005 |
| JP | 2005-336503 | A | | 12/2005 |
| JP | 2007031793 | A | * | 2/2007 |
| JP | 2008-285721 | A | | 11/2008 |
| JP | 2011-080140 | A | | 4/2011 |
| KR | 10-2002-0044243 | A | | 6/2002 |
| KR | 10-2002-0044244 | A | | 6/2002 |
| KR | 10-2006-0003367 | A | | 1/2006 |
| KR | 2011-01062312 | A | | 6/2011 |
| WO | 2011/114178 | A1 | | 9/2011 |

OTHER PUBLICATIONS

European Search Report dated Dec. 10, 2016 issued in European Patent Application No. 12891023.9.
Chinese Office Action dated Mar. 28, 2016 issued in Chinese Patent Application No. 201280078161.1.
European Search Report dated May 18, 2016 issued in European Patent Application No. 12891023.9.
Japanese Office Action dated Jul. 26, 2016 issued in Japanese Patent Application No. 2015-551045 (with English translation).
Japanese Office Action dated Apr. 4, 2017 issued in Japanese Patent Application No. 2015-551045 (with English translation).

* cited by examiner

GRAIN ORIENTED ELECTRICAL STEEL SHEET HAVING EXCELLENT CORE LOSS, AND METHOD FOR MANUFACTURING SAME

RELATED APPLICATIONS

This application is the U.S. National Phase under 35 U.S.C. §371 of International Application No. PCT/KR2012/011749, filed on Dec. 28, 2012 which in turn claims the benefit of Korean Patent Application No. 10-2012-0154611 filed on Dec. 27, 2012, the disclosures of which the applications are incorporated by reference herein.

TECHNICAL FIELD

The present disclosure relates to a grain-oriented electrical steel sheet having a low degree of core loss and a method for manufacturing the grain-oriented electrical steel sheet.

BACKGROUND ART

Electrical steel sheets have a high degree of permeability and a low degree of core loss, and are thus frequently used as materials for cores, etc. Electrical steel sheets may be broadly categorized as grain-oriented electrical steel sheets and non-oriented electrical steel sheets.

Grain-oriented electrical steel sheets are characterized by {110}<001> grains having a {110} plane parallel to the rolled surface and a <001> axis (magnetic easy axis) parallel to the rolling direction. Grain-oriented electrical steel sheets have superior magnetic characteristics in a particular direction, and are thus widely used as material for cores of devices that are used at a fixed position, such as transformers, electric motors, generators, or other electric devices. The magnetic characteristics of grain-oriented electrical steel sheets may be expressed by magnetic flux density and core loss. A grain-oriented electrical steel sheet having a higher degree of magnetic flux density and a lower degree of core loss is favored. In general, the magnetic flux density of electrical steel sheets is expressed by B8 values measured in a magnetic field of 800 Amp/m, and the core loss of electrical steel sheets is expressed by W17/50 indicating lost watts per kilogram at 50 Hz and 1.7 Tesla.

N. P. Goss developed an early technique for grain-oriented electrical steel sheets. According to the technique, grains of steel are oriented in the {110}<001> orientation (known as Goss orientation) by a cold rolling method. Thereafter, the technology for grain-oriented electrical steel sheets has been developed up to the present level.

That is, it is necessary to increase the proportion of grains having {110}<001> orientation or a similar orientation so as to manufacture a grain-oriented electrical steel sheet. A heating process is necessary to induce recrystallization of grains of steel sheets, and thus to orient the grains of the steel sheets. In an annealing process, however, the growth of crystals generally occurs in random orientations. Therefore, a particular method is necessary to obtain grain-oriented electrical steel sheets having grains grown in a particular direction.

In general, electrical steel sheets are annealed in two steps: primary recrystallization annealing and secondary recrystallization annealing. Primary recrystallization occurs by using energy accumulated during a cold rolling process as a driving force, and secondary recrystallization occurs by using boundary energy of primarily recrystallized grains as a driving force. During the secondary recrystallization which is also called "abnormal grain growth," grains grow to a size of several millimeters (mm) to several centimeters (cm).

However, secondarily recrystallized grains have different orientations depending on the temperature of recrystallization. If the secondary recrystallization occurs at a certain temperature, the proportion of grains having Goss orientation increases, and thus an electrical steel sheet having a low degree of core loss may be obtained.

Therefore, it is necessary to suppress the secondary recrystallization until the temperature reaches a certain level at which grains having Goss orientation are obtainable and to start the secondary recrystallization at a certain temperature. Generally, inhibitors are used for this purpose. Inhibitors exist in the form of precipitates in steel and suppress the movement of grain boundaries and the formation of new grains. If a proper inhibitor is selected, the inhibitor may not obstruct the growth of grains at a recrystallization temperature at which the grains recrystallize as grains having Goss orientation, for example, because the inhibitor is dissolved or removed at the recrystallization temperature, and thus the recrystallization and growth of grains having Goss orientation may markedly occur at the recrystallization temperature.

Therefore, the selection of a proper inhibitor may be a crucial factor in increasing the proportion of grains having Goss orientation in electrical steel sheets and reducing the core loss of the electrical steel sheets. An MnS-based inhibitor, developed by ARMCO, USA, may be the first inhibitor. However, in techniques in which MnS-based inhibitors are used, since MnS exists as coarse particles in steel slabs and thus does not function as an inhibitor, MnS is first dissolved through a solid solution treatment and is then precipitated as fine particles. To this end, slabs are heated to 1350° C. or higher to sufficiently dissolve MnS. However, the slab heating temperature is much higher than a temperature to which steel slabs are generally heated and thus may decrease the lifespan of a heating furnace, thereby causing problems such as a decrease in the lifespan of a heating furnace or corrosion of a slab due to silicon oxides melting and flowing on the surface of the slab. In addition, a method of manufacturing non-oriented electrical steel sheets through two cold rolling processes and an intermediate annealing process therebetween has been proposed by ARMCO. However, electrical steel sheets manufactured by the method thereof do not have sufficient magnetic characteristics.

In 1968, Nippon Steel Corporation proposed a new conceptual electric steel sheet product named "Hi-B." The electric steel sheet product Hi-B uses AlN and MnS as inhibitors and is producible through a single cold rolling process. Although the electric steel sheet product Hi-B has a high degree of magnetic flux density and a low degree of core loss, a slab has to be heated to a high temperature during a solid solution treatment process so as to dissolve inhibitors.

JFE has proposed another electrical steel sheet using MnSe and antimony (Sb) as inhibitors. However, the electrical steel sheet is also disadvantageous in that a slab has to be heated to a high temperature.

To address problems of such high-temperature heating methods of the related art, a low-temperature heating method has been developed. According to the low temperature heating method, inhibitors are not formed at the beginning of a manufacturing process but are formed immediately before secondary recrystallization so that the slab heating temperature may be decreased to 1300° C. or lower, or 1280° C. or lower. The core technology of the low-temperature heating method is a nitriding annealing process in which nitrogen (N) necessary for forming AlN functioning as an inhibitor is added to steel by diffusing nitrogen gas at a later stage of manufacturing. Therefore, a high-temperature heating process is not necessary for dissolving aluminum (Al) and nitrogen (N) and forming AlN. Thus, various process problems of high-temperature heating methods could be solved.

A method of increasing the specific resistance of electrical steel sheets may be considered an important method of decreasing the core loss of electrical steel sheets. That is, as shown in Formula 1 below, the core loss of steel sheets is reverse proportional to the specific resistance of the steel sheets. Thus, particular elements may be added to steel sheets to increase the specific resistance of the steel sheets.

$$W_{ec}=(\pi^2\cdot d^2\cdot I^2\cdot f^2)/(\rho\cdot 6) \quad \text{[Formula 1]}$$

where $W_{ec}$: core loss, d: crystal diameter, I: current, f: frequency, and ρ: specific resistance.

An exemplary element that increases the specific resistance of electrical steel sheets is silicon (Si). That is, the core loss of electrical steel sheets may be reduced by adding as much silicon (Si) as possible to the electrical steel sheets. However, if an excessive amount of silicon (Si) is added to a steel sheet, the brittleness of the steel sheet is increased, and thus cold-rolling characteristics of the steel sheet are deteriorated. Therefore, the method of adding silicon (Si) has practical limitations. Like silicon (Si), phosphorus (P) may increase the specific resistance of steel sheets. However, since even a very small amount of phosphorus (P) increases the brittleness of steel sheets, there is also a limit to adding phosphorus (P).

DISCLOSURE

Technical Problem

Aspects of the present disclosure may provide an improved electrical steel sheet having superior magnetic characteristics such as a low degree of core loss and designed to be manufactured by a low-temperature heating method, and an improved method for manufacturing the electrical steel sheet.

However, the present disclosure is not limited to the above-mentioned aspects. The above-mentioned aspects and other aspects of the present disclosure will be clearly understood by those of skill in the art through the following description.

Technical Solution

According to an aspect of the present disclosure, an electrical steel sheet having a low degree of core loss may include, by wt %, silicon (Si): 1.0% to 4.0%, aluminum (Al): 0.1% to 4.0%, and at least one rare earth element: 0.05% to 0.5% in total content.

The electrical steel sheet may further include carbon (C): 0.003 wt % or less, manganese (Mn): 0.03 wt % to 0.2 wt %, sulfur (S): 0.001 wt % to 0.05 wt %, and nitrogen (N): 0.01 wt % or less.

The electrical steel sheet may further include at least one selected from the group consisting of phosphorus (P): 0.5% or less, tin (Sn): 0.3% or less, antimony (Sb): 0.3% or less, chromium (Cr): 0.3% or less copper (Cu): 0.4% or less, and nickel (Ni): 1% or less.

The rare earth element or a compound of the rare earth element may be used as an inhibitor.

According to another aspect of the present disclosure, a method for manufacturing an electrical steel sheet having a low degree of core loss may include: heating a slab to 1050° C. to 1300° C., the slab including, by wt %, silicon (Si): 1.0% to 4.0%, aluminum (Al): 0.1% to 4.0%, and at least one rare earth element: 0.05% to 0.5% in total content; hot rolling the slab; cold rolling the slab; primarily recrystallizing the slab; and secondarily recrystallizing the slab.

The slab may further include carbon (C): 0.1 wt % or less, manganese (Mn): 0.03 wt % to 0.2 wt %, sulfur (S): 0.001 wt % to 0.05 wt %, and nitrogen (N): 0.01 wt % or less.

After the hot rolling of the slab, the method may further include at least one selected from: annealing the hot-rolled slab; and pickling the hot-rolled slab.

The cold rolling may be performed at a reduction ratio of 85% to 90%.

The cold rolling may be performed two or more times with an intermediate annealing process therebetween, and a reduction ratio of the final cold rolling may be 60% or greater.

The primary recrystallizing may be performed within a temperature range of 700° C. to 950° C.

The secondary recrystallizing may be performed by heating the slab to a maximum temperature of 1100° C. to 1300° C. at a heating rate of 5° C./hr to 30° C./hr.

Advantageous Effects

As described above, according to the present disclosure, rare earth metals (REMs) are used as inhibitors, and a large amount of aluminum (Al) is added to a steel sheet to increase the specific resistance of the steel sheet, thereby markedly decreasing the core loss of the steel sheet.

BEST MODE

Figure 1B:
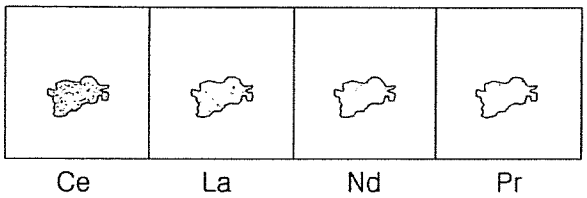
FIGS. 1A and 1B are images taken with a microscope to show inhibitors formed in steel sheets to which rare earth elements are added.

The present disclosure will now be described in detail.

The inventors have conducted research into a method of manufacturing an electric steel sheet having a low degree of core loss by adding an inhibitor to increase the number of particles having Goss orientation and the specific resistance of the electric steel sheet without increasing the brittleness of the electric steel sheet. As a result, the inventors have found that the objects as described above could be achieved by adding a rare earth metal (REM) (hereinafter referred to as a "rare earth element") to an electrical steel sheet and increasing the content of aluminum (Al) in the electrical steel sheet. Based on this knowledge, the inventors have invented the present invention.

That is, according to the present disclosure, aluminum (Al) is added to an electrical steel sheet in an amount of 0.1 wt % or greater. According to results of the research conducted by the inventors, like silicon (Si), aluminum (Al) has a significant effect on increasing the specific resistance of a steel sheet but does not increase the brittleness of the steel sheet if the content of aluminum (Al) is within a certain range. Although silicon (Si) is additionally added to a steel sheet to increase the specific resistance of the steel sheet, the content of silicon (Si) in the steel sheet is limited because silicon (Si) may increase the brittleness of the steel sheet. Therefore, aluminum (Al) may be used together with silicon (Si) to increase the specific resistance of a steel sheet without increasing the brittleness of the steel sheet. To this end, it may be preferable that aluminum (Al) be added in an amount of 0.1 wt % or greater. However, if the content of aluminum (Al) in the electrical steel sheet is excessively high, the brittleness of the electrical steel sheet is increased. Therefore, the content of aluminum (Al) may be adjusted to be 4.0 wt % or less so as not to affect cold rolling characteristics of the electrical steel sheet.

The above-mentioned aluminum (Al) content range is much higher than the aluminum (Al) content range (for example, 0.05 wt % or less) of general electrical steel sheets using AlN as an inhibitor. That is, if aluminum (Al) is added within the content range of the present disclosure, it may be difficult to finely and uniformly distribute AlN functioning as an inhibitor, and thus AlN may not sufficiently function as an inhibitor for inducing the formation of particles having Goss orientation.

Therefore, the present disclosure proposes a new conceptual inhibitor instead of an AlN inhibitor, so as to improve both the specific resistance and the crystal orientation of electrical steel sheets. To this end, rare earth elements are used as inhibitor forming elements in the present disclosure. Rare earth elements are 17 elements consisting of: scandium (Sc) and yttrium (Y) included in group 3, and the 15 elements with atomic numbers 57 to 71 (the lanthanides) in the periodic table. The rare earth elements serve individually or in the form of a compound with sulfur (S) or oxygen (O) to hinder the movement of boundaries of primarily recrystallized grains but do not hinder the growth of grains having Goss orientation at a secondary recrystallization temperature, thereby having a significant effect on increasing the proportion of particles having Goss orientation. In addition, a compound of a rare earth element is finely and uniformly distributed in a cast slab, and thus it is unnecessary to perform a solid solution treatment on the slab in a later process to finely precipitate the compound. Owing to this, a slab heating temperature may be adjusted within the range of a general low-temperature heating method, and thus problems of high-temperature heating methods may not occur.

One of the rare earth elements may be used, or two or more of the rare earth elements may be used. For example, the total content of rare earth elements in a steel sheet may be adjusted to be 0.05% or greater so as to obtain sufficient inhibitor effects. However, if the total content of rare earth elements is excessively high, coarse compounds may be formed. Thus, the upper limit of the total content of rare earth elements is set to 0.5 wt %. Coarse compounds may not have a sufficient effect on suppressing the growth of grains during primary recrystallization. According to an exemplary embodiment of the present disclosure, a rare earth element or rare earth elements may be added to an electrical steel sheet in a total amount of 0.065% to 0.4% so as to further reduce the core loss of the electrical steel sheet.

That is, an electrical steel sheet of the present disclosure may include aluminum (Al) and at least one rare earth element (REM) in addition to silicon (Si). In this case, the content of silicon (Si) in the electrical steel sheet may be adjusted to be within the range of 1.0 wt % to 4.0 wt % due to the following reasons.

That is, as described above, silicon (Si) may be added in an amount of 1.0% or greater to increase the specific resistance of the electrical steel sheet. As the content of silicon (Si) increases, the specific resistance of the electrical steel sheet increases, and thus the core loss of the electrical steel sheet may decrease. That is, a high content of silicon (Si) may be favored. However, since electrical steel sheets are generally manufactured through a cold rolling process, the content of silicon (Si) may be adjusted to be 4.0 wt % or less by taking into consideration cold-rolling characteristics.

Therefore, the electrical steel sheet of the present disclosure may include, by wt %, silicon (Si): 1.0% to 4.0%, aluminum (Al): 0.1% to 4.0%, and at least one rare earth element: 0.05% to 0.5% in total content.

In addition, the electrical steel sheet of the present disclosure may further include additional elements and inevitable impurities, and there is no particular limit to such additional elements or impurities. For example, elements such as carbon (C), manganese (Mn), sulfur (S), or nitrogen (N) may be additionally added to the electrical steel sheet of the present disclosure, and according to some embodiments of the present disclosure, the contents of the elements may be adjusted as follows.

Carbon (C): 0.003 wt % (30 Ppm) or Less

A large amount of carbon (C) may be present in a slab, for example, due to the load of a decarbonizing process. However, since carbon (C) causes magnetic aging, the content of carbon (C) in a final product (electrical steel sheet) may be adjusted to be low. That is, the content of carbon (C) in the electrical steel sheet of the present disclosure is limited to 0.003 wt % or less. As described above, since carbon (C) is an undesirable impurity in a final product, the content of carbon (C) in the electrical steel sheet of the present disclosure does not have a particular minimum limit.

Manganese (Mn): 0.03 wt % to 0.2 wt %

Manganese (Mn) lowers a solid-solution temperature at which precipitates dissolve during a reheating process and prevents the creation of cracks in both ends of a steel sheet during a hot rolling process. To obtain these effects, manganese (Mn) may be added in an amount of 0.03% or greater. However, if manganese (Mn) is added in excessively large amounts, Mn oxides and MnS may be formed, and thus the function of the rare earth element may be lowered to result in a high degree of core loss. Therefore, it may be preferable that the content of manganese (Mn) be within the range of 0.03 wt % to 0.2 wt %.

Sulfur (S): 0.001 wt % to 0.05 wt %

Sulfur (S) may combine with the rare earth element to form an inhibitor. To this end, it may be preferable that sulfur (S) be added in an amount of 0.001 wt % or greater. However, an excessively high content of sulfur (S) may lead to the formation of a coarse sulfur compound which does not properly function as an inhibitor suppressing the growth of primarily recrystallized grains. Therefore, the upper limit of the sulfur (S) content is set to be 0.05 wt %.

Nitrogen (N): 0.01 wt % or Less

If nitrogen (N) is added to some electrical steel sheets, nitrogen (N) functions as an inhibitor. However, since the electrical steel sheet of the present disclosure does not actively use a nitride inhibitor, nitrogen (N) is not actively added. In addition, if an excessive amount of nitrogen (N) is added to steel, the steel may undergo swelling called blisters. Therefore, the content of nitrogen (N) in the electrical steel sheet of the present disclosure is limited to 0.01 wt % or less.

In addition to the above-listed elements, the electrical steel sheet of the present disclosure may further include other elements such as phosphorus (P), tin (Sn), antimony (Sb), chromium (Cr), copper (Cu), or nickel (Ni) that are usually included in general electrical steel sheets. The contents of such elements in the electrical steel sheet of the present disclosure are not limited to specific ranges as long as the contents of the elements are within generally-acceptable ranges. For example, the electrical steel sheet of the present disclosure may further include one or more of phosphorus (P): 0.5% or less, tin (Sn): 0.3% or less, antimony (Sb): 0.3% or less, chromium (Cr): 0.3% or less, copper (Cu): 0.4% or less, and nickel (Ni): 1% or less.

As described above, the electrical steel sheet of the present disclosure includes a large amount of aluminum (Al), and at least one rare earth element or a compound of the rare earth element is present as an inhibitor in the electrical steel sheet. The aluminum (Al) may increase the specific resistance of the electrical steel sheet, and the inhibitor may increase the proportion of particles having Goss orientation in the electrical steel sheet.

As a result, according to an exemplary embodiment, the electrical steel sheet may have a high degree of magnetic flux density within the range of 1.8 T or greater in B8 and a low degree of core loss.

The electrical steel sheet of the present disclosure may be manufactured by a method used to manufacture general electrical steel sheets. That is, the electrical steel sheet of the present disclosure is not limited to a specific manufacturing method. However, an exemplary embodiment is proposed by taking into consideration the characteristic composition of the electrical steel sheet and resulting behaviors of the inhibitor.

That is, the electrical steel sheet of the present disclosure may be manufactured by a low-temperature heating method including a primary recrystallization annealing process and a secondary recrystallization annealing process after a hot rolling process and a cold rolling process. Specific conditions thereof are as follows.

First, a slab is heated. In the present disclosure, the slab has substantially the same composition as the composition of the electrical steel sheet. However, since carbon (C) is removed from the slab in a later decarbonization annealing process, the content of carbon (C) in the slab may be higher than the content of carbon (C) (for example, 0.0003 wt % or less) in the electrical steel sheet. If the content of carbon (C) in the slab is excessively high, the load of a decarbonization process may be increased, and thus productivity may be decreased. Therefore, the content of carbon (C) in the slab for forming the electrical steel sheet of the present disclosure may be within the range of 0.10 wt % or less. Since carbon (C) is an optional element, the minimum limit of the content of carbon (C) in the slab may not be set. However, if the content of carbon (C) in the slab is excessively low, phase transformation may not sufficiently occur in the slab during a hot rolling process, and thus nuclei of {110}<001> Goss grains may not be sufficiently formed. In this case, the magnetic characteristics of the electrical steel sheet may be deteriorated. Therefore, the lower limit of the content of carbon (C) in the slab may be set to be 0.01 wt %.

Furthermore, at least one rare earth element may be added during a steel making process, and thus the electrical steel sheet of the present disclosure may include at least one rare earth element as described above. In the case of adding two or more rare earth elements, the rare earth elements may be added in the form of a mischmetal in which rare earth elements are mixed. That is, since rare earth elements have similar chemical properties and are difficult to separate from each other, rare earth elements may be smelted in a mixed state. For example, depending on the kind of ore (such as moissanite or bastnasite), a salt in which several rare earth elements are mixed may be obtained. Such a mixed salt is reduced with a reactive metal such as manganese (Mn), calcium (Ca), or sodium (Na), or is electrolyzed so as to obtain a metal. This metal includes a plurality of elements and is called a "mischmetal." A mischmetal may be used to control the contents of rare earth elements during a steel making process, and if the total content of rare earth elements is within the above-mentioned range of the present disclosure, the composition or type of the mischmetal are not limited.

In the present disclosure, at least one rare earth element is used as an inhibitor forming element, and an inhibitor formed of the rare earth element may be uniformly and finely distributed in steel even though a solid solution treatment necessary for the case of using other inhibitors such as MnS or MnSe is not performed. Therefore, a high-temperature heating process is not necessary. As such, in the present disclosure, the slab may be heated to 1300° C. or lower so as to lower the load of a heating furnace and prevent silicon (Si) oxides formed on the surface of the slab from melting. More preferably, the slab may be heated to 1250° C. or lower. However, when a later hot rolling process is considered, it may be preferable that the slab be heated to 1050° C. or higher.

After the slab is heated as described above, the slab may be hot rolled. The slab may be hot rolled by a general method. According to an exemplary embodiment, the slab may be hot rolled to obtain a hot-rolled steel sheet having a thickness of 2.0 mm to 3.0 mm. In this case, the load of a later cold rolling process may not be excessive, and a sufficient reduction ratio may be obtained in the later cold rolling process.

Then, the hot-rolled steel sheet may be subjected to a hot band annealing process or a pickling process. However, these processes are not essential.

After the hot rolling process and the optional hot band annealing process, the steel sheet may be subjected to a cold rolling process. The cold rolling process may be performed once, twice, or more times with an intermediate annealing process therebetween. The cold rolling process is important for texturing the steel sheet and may preferably be performed at a reduction ratio of 85% to 90% (total reduction ratio if performed two or more times). That is, the reduction ratio of the cold rolling process may preferably be 85% or greater so as to sufficiently texture the steel sheet and thus induce the formation of a large number of grains having Goss orientation after primary recrystallization and secondary recrystallization. However, if the reduction ratio of the cold rolling process is excessively high, the load of the cold rolling process may also be excessive. Thus, the upper limit of the reduction ratio is set to 90%.

If the cold rolling process is performed two or more times with an intermediate annealing process therebetween, the reduction ratio of the final cold rolling process (for example, the second time if performed twice) may be 50% or greater.

Thereafter, the cold-rolled steel sheet may be processed through a primary recrystallization annealing process. Preferably, the primary recrystallization annealing process may be performed within the temperature range of 700° C. to 950° C. for sufficient recrystallization. According to an exemplary embodiment, another purpose of the primary recrystallization annealing process may be decarbonization as described later. If the primary recrystallization annealing process is performed at 700° C. or lower, decarbonization may occur, and if the primary recrystallization annealing process is performed at 950° C. or higher, primarily recrystallized grains may be coarse. In this case, the driving force for secondary recrystallization may be weak, and thus Goss grains may not be fully developed.

The primary recrystallization annealing process may be performed under a wet atmosphere of hydrogen and nitrogen for decarbonizing the steel sheet. In this case, the primary recrystallization annealing process may also be called a "decarbonization annealing process." Conditions of the decarbonization annealing process such as a gas mixing ratio or a dew point are similar to those of a decarbonization annealing process for general electrical steel sheets, and thus there is no particular limit to the conditions.

After the primary recrystallization annealing process, the steel sheet is additionally heated for the following secondary recrystallization annealing process. In the secondary recrystallization annealing process, the steel sheet may preferably be heated at a heating rate of 5° C./hr to 30° C./hr to a final temperature of 1100° C. to 1300° C. If the heating rate is 5° C./hr or lower, the productivity of the secondary recrystallization annealing process may be lowered due to a long annealing time. In addition, the primarily recrystallized grains may become coarse before a secondary recrystallization temperature, and thus the driving force for secondary recrystallization may be weak. On the contrary, if the heating rate is 30° C./hr or higher, the inside and outside of a coil of the steel sheet may have different temperatures, and thus secondary recrystallization may non-uniformly occur, thereby deteriorating magnetic characteristics of the steel sheet.

In addition, it may be preferable that the secondary recrystallization annealing process be performed within the temperature range of 1100° C. to 1300° C. for inducing the recrystallization of most of the grains of the steel sheet. Even if the maximum temperature of secondary recrystallization is 1100° C., secondary recrystallization may occur completely. However, small grains located inside secondarily recrystallized grains may not be completely removed, and thus the core loss of the steel sheet may be increased. If secondary recrystallization occurs at 1300° C. or higher, the coil of the steel sheet may undergo deformation, and thus productivity may be lowered.

In some cases, the steel sheet may be coated with an annealing separator before the secondary recrystallization annealing process. Any material such as MgO or $Al_2O_3$ widely used in the art to which the present disclosure pertains may be used as the annealing separator.

In addition, any process not described in the above but used to manufacture general electrical steel sheets may be used for manufacturing the electrical steel sheet of the present disclosure.

MODE FOR INVENTION

Hereinafter, the idea of the present disclosure will be described more specifically through examples. However, the following examples are for illustrative purposes only and are not intended to limit the scope of the present invention. That is, the scope of the present invention is defined by the claims, and modifications and variations reasonably made therefrom.

EXAMPLES

Example 1

A molten steel producing process was performed to obtain molten steel samples, each including carbon (C): 0.05 wt %, manganese (Mn): 0.07 wt %, sulfur (S): 0.007 wt %, nitrogen (N): 0.006 wt %, and silicon (Si), aluminum (Al), and at least one rare earth element as shown in Table 1 (in which element contents are expressed in wt %). When the molten steel samples were prepared, rare earth elements were added individually or in the form of mischmetals according to the compositions of the molten steel samples. The molten steel samples were cast into slabs having a thickness of 250 mm, and the slabs were heated to 1150° C. Then, the slabs were subjected to a hot rolling process to obtain hot-rolled steel sheets having a thickness of 2.3 mm. Then, a hot band annealing process was performed by heating the hot-rolled steel sheets to 1100° C., and the steel sheets were cooled and pickled. Thereafter, a cold rolling process was performed once on the pickled steel sheets to obtain cold-rolled steel sheets having a thickness of 0.27 mm. The cold-rolled steel sheets were heated to 830° C. under a wet atmosphere of hydrogen and nitrogen for primary recrystallization and decarbonization up to a residual carbon level of 30 ppm. Thereafter, the steel sheets were heated to 1200° C. at a heating rate of 15° C./hr for secondary recrystallization, and then the steel sheets were cooled. In this manner, electrical steel sheets were prepared under various conditions. In Table 1 below, B8 refers to magnetic flux density, and W17/50 refers to core loss.

TABLE 1

| | | | ***REEs (individually or as a mischmetal) | | | | | W17/50 |
|---|---|---|---|---|---|---|---|---|
| NO. | Si | Al | La | Pr | Ce | others | B8 (T) | (W/kg) |
| *CSS 1 | 0.5% | 4.5% | 0.1% | — | | | 1.551 | 5.811 |
| CSS 2 | 4.2% | 0.5% | | 0.2% | | | 1.580 | 4.512 |
| **ISS 1 | 2% | 3.0% | | 0.1% | | | 1.905 | 0.895 |
| ISS 2 | 2% | 3.0% | | | 0.1% | | 1.912 | 0.889 |
| ISS 3 | 2% | 3.0% | 0.05% | 0.05% | 0.04% | Nd 0.1% | 1.903 | 0.891 |
| CSS 3 | 2% | 3% | | 0.6% | | | 1.754 | 1.983 |
| CSS 4 | 2% | 3% | 0.2% | 0.2% | 0.2% | | 1.789 | 2.208 |
| ISS 4 | 1.8% | 2.7% | | 0.2% | | | 1.904 | 0.901 |
| CSS 5 | 2.5% | 1.5% | 0.3% | 0.2% | 0.2% | Y 0.1% | 1.690 | 4.609 |
| ISS 5 | 3.1% | 1.0% | 0.15% | | | | 1.913 | 0.867 |
| ISS 6 | 3.1% | 1.0% | | 0.15% | | | 1.903 | 0.874 |
| ISS 7 | 3.1% | 1.0% | | | 0.15% | Nd 0.1% | 1.919 | 0.888 |
| CSS 6 | 3.1% | 1.0% | 0.4% | | 0.15% | | 1.760 | 2.471 |
| ISS 8 | 3.1% | 1.0% | 0.15% | | | Nd 0.2% | 1.921 | 0.865 |
| ISS 9 | 3.1% | 1.0% | | 0.15% | | Y 0.1% | 1.918 | 0.861 |
| ISS 10 | 2.9% | 1.5% | 0.15% | 0.15% | | | 1.900 | 0.881 |
| ISS 11 | 2.9% | 1.5% | | | | | 1.908 | 0.870 |
| ISS 12 | 2.9% | 1.5% | | | 0.15% | Nd 0.1% | 1.910 | 0.866 |
| CSS 7 | 2.9% | 1.5% | 0.4% | 0.17% | | | 1.800 | 1.498 |

TABLE 1-continued

| NO. | Si | Al | ***REEs (individually or as a mischmetal) La | Pr | Ce | others | B8 (T) | W17/50 (W/kg) |
|---|---|---|---|---|---|---|---|---|
| ISS 13 | 2.9% | 1.5% | 0.15% | | | Nd 0.2% | 1.911 | 0.859 |
| ISS 14 | 2.9% | 1.5% | | 0.15% | | Y 0.1% | 1.915 | 0.877 |
| CSS 8 | 1.3% | 3.5 | | | | | 1.489 | 4.352 |
| CSS 9 | 3.1 | 1.0 | 0.01% | 0.02% | | | 1.540 | 1.761 |

*CSS: Comparative Steel Sample,
**ISS: Inventive Steel Sample,
***REEs: Rare Earth Elements Comparative steel sample 1 had a lower silicon (Si) content and a higher aluminum (Al) content when compared to the ranges recommended in the present disclosure. Due to the excessive amount of aluminum (Al), Comparative steel sample 1 had poor cold-rolling characteristics, a low degree of magnetic flux density, and a high degree of core loss. Comparative steel sample 2 having an excessive amount of silicon (Si) had properties similar to those of Comparative steel sample 1.

Comparative steel samples 3, 4, 5, 6, and 7 contained excessive amounts of rare earth elements, and thus the magnetic flux density and core loss thereof were unsatisfactory.

Comparative steel sample 8 contained no rare earth element but a large amount of aluminum (Al). Aluminum (Al) added in large amounts was not so useful for the formation of an inhibitor. Moreover, since a nitriding annealing process was not performed, there was very little possibility of formation of an inhibitor in Comparative steel sample 8, and thus the magnetic flux density and core loss of Comparative steel sample 8 were very unsatisfactory. The total content of rare earth elements in Comparative steel sample 9 was outside the range of the present disclosure, and thus the magnetic flux density and core loss of Comparative steel sample 9 were unsatisfactory even though they were superior to those of Comparative steel sample 8.

However, all inventive steel samples having compositions in accordance with the present disclosure had a magnetic flux density of 1.9 T or greater and a core loss of 0.901 W/kg or less.

Example 2

In this example, the mechanism of how added rare earth elements function as inhibitors was checked by preparing electrical steel slabs having modified compositions. That is, the electrical steel slabs each included carbon (C): 0.05 wt %, manganese (Mn): 0.07 wt %, sulfur (S): 0.007 wt %, nitrogen (N): 0.006 wt %, silicon (Si): 3.1 wt %, aluminum (Al): 1.5 wt %, and praseodymium (Pr) (rare earth element): 0.08 wt % (refer to FIG. 1A) or rare earth elements: 0.24 wt % in total content (corresponding to Inventive steel sample 3 to which a mischmetal was added). AS in Example 1, the electrical steel slabs were subjected to a hot rolling process, a cold rolling process, and a primary recrystallization process to obtain primarily recrystallized steel sheets. Thereafter, inhibitors formed in the primarily recrystallized steel sheets were photographed with a transmission electron microscope by a replica method, and the captured images are shown in FIGS. 1A and 1B.

Figure 1A:
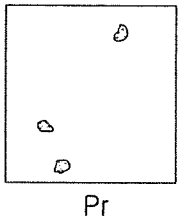

As shown in FIGS. 1A and 1B, when praseodymium (Pr) was added (refer to FIG. 1A), praseodymium (Pr) or a compound of praseodymium (Pr) was detected as an inhibitor, and when a mischmetal was added (refer to FIG. 1B), cerium (Ce), lanthanum (La), neodymium (Nd), and praseodymium (Pr) included in the mischmetal were detected as inhibitors. That is, it could be checked that rare earth elements serve as satisfactory inhibitors as described in the present disclosure.

Example 3

Figure 2A:
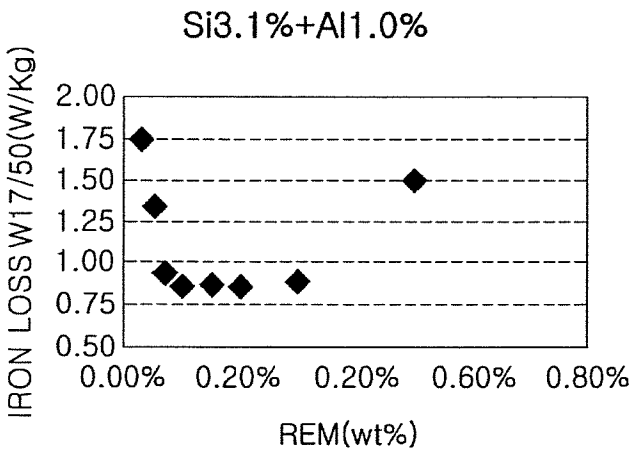
FIGS. 2A and 2B are graphs illustrating core loss according to the total content of rare earth elements.
Figure 2B:
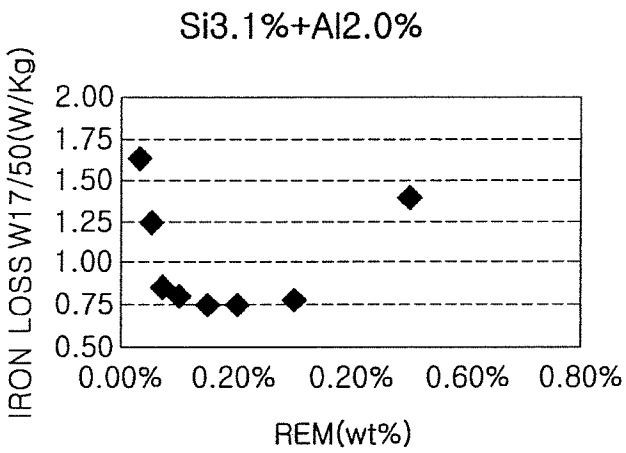

Electrical steel sheets were prepared by the same method as that in Example 1 by using slabs each including carbon (C): 0.05 wt %, manganese (Mn): 0.07 wt %, sulfur (S): 0.007 wt %, nitrogen (N): 0.006 wt %, and silicon (Si): 3.1 wt % and aluminum (Al): 1.0 wt % (refer to FIG. 2A), or silicon (Si): 3.1 wt % and aluminum (Al): 2.0 wt % (refer to FIG. 2B). Subsequently, a relationship between core loss and total content of rare earth elements of each electrical steel sheet was plotted as shown in FIGS. 2A and 2B. As shown in FIGS. 2A and 2B, if the total content of rare earth elements is within the range of the present disclosure, core loss is relatively very low.

Therefore, advantageous effects of the present disclosure could be confirmed.

The invention claimed is:

1. A grain oriented electrical steel sheet having a low degree of core loss of 0.901 W/kg or lower (W17/50), the electrical steel sheet comprising, by wt %, silicon (Si): 1.0% to 4.0%, aluminum (Al): 0.1% to 4.0%, at least one rare earth element: 0.065% to 0.4%, and at least one selected from the group consisting of phosphorus (P): 0.5% or less, tin (Sn): 0.3% or less, antimony (Sb): 0.3% or less, chromium (Cr): 0.3% or less, copper (Cu): 0.4% or less, and nickel (Ni): 1% or less in total content, wherein the at least one rare earth elements exist individually or in the form of a compound with sulfur (S) or oxygen (O) and the at least one rare earth element or the compound of the at least one rare earth element is used as an inhibitor.

2. The grain oriented electrical steel sheet of claim 1, further comprising carbon (C): 0.003 wt % or less, manganese (Mn): 0.03 wt % to 0.2 wt %, sulfur (S): 0.001 wt % to 0.05 wt %, and nitrogen (N): 0.01 wt % or less.

3. A method for manufacturing the grain oriented electrical steel sheet of claim 1, the method comprising:

heating a slab to 1050° C. to 1300° C., the slab comprising, by wt %, silicon (Si): 1.0% to 4.0%, aluminum (Al): 0.1% to 4.0%, and at least one rare earth element: 0.065% to 0.4% in total content;

hot rolling the slab;

cold rolling the slab;

primarily recrystallizing the slab; and secondarily recrystallizing the slab.

4. The method of claim 3, wherein the slab further comprises carbon (C): 0.1 wt % or less, manganese (Mn): 0.03 wt % to 0.2 wt %, sulfur (S): 0.001 wt % to 0.05 wt %, and nitrogen (N): 0.01 wt % or less.

5. The method of claim 3, wherein after the hot rolling of the slab, the method further comprises at least one selected from;

annealing the hot-rolled slab; and pickling the hot-rolled slab.

6. The method of claim 3, wherein the cold rolling is performed at a reduction ratio of 85% to 90%.

7. The method of claim 6, wherein the cold rolling is performed two or more times with an intermediate annealing process therebetween, and a reduction ratio of the final cold rolling is 50% or greater.

8. The method of claim 3, wherein the primary recrystallizing is performed within a temperature range of 700° C. to 950° C.

9. The method of claim 3, wherein the secondary recrystallizing is performed by heating the slab to a maximum temperature of 1100° C. to 1300° C. at a heating rate of 5° C./hr to 30° C./hr.

* * * * *